US009943196B2

(12) United States Patent
Mak et al.

(10) Patent No.: US 9,943,196 B2
(45) Date of Patent: Apr. 17, 2018

(54) SEQUENTIALLY ACTIVATED MULTI-DIAPHRAGM FOAM PUMPS, REFILL UNITS AND DISPENSER SYSTEMS

(71) Applicant: GOJO Industries, Inc., Akron, OH (US)

(72) Inventors: Wing-Hoi Ringo Mak, New Territories (HK); Zhen-He Huang, Shenzhen (CN); Xiao Huang, Shenzhen (CN); Chung-Ming Yiu, New Territories (HK); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 15/350,185

(22) Filed: Nov. 14, 2016

(65) Prior Publication Data

US 2017/0135531 A1 May 18, 2017

Related U.S. Application Data

(60) Provisional application No. 62/254,430, filed on Nov. 12, 2015.

(51) Int. Cl.
*A47K 5/16* (2006.01)
*A47K 5/14* (2006.01)
(Continued)

(52) U.S. Cl.
CPC ..... *A47K 5/14* (2013.01); *B05B 7/0018* (2013.01); *B05B 7/0416* (2013.01);
(Continued)

(58) Field of Classification Search
CPC .... F04B 13/02; F04B 43/0045; F04B 43/025; F04B 43/026; F04B 43/04; F04B 53/10;
(Continued)

(56) References Cited

U.S. PATENT DOCUMENTS 3,937,364 A 2/1976 Wright
3,970,219 A 7/1976 Spitzer
(Continued)

FOREIGN PATENT DOCUMENTS

CN 202370781 U 8/2012
CN 202493407 U 10/2012
(Continued)

OTHER PUBLICATIONS

Office Action for U.S. Appl. No. 151355,112 dated Dec. 29, 2017.
(Continued)

*Primary Examiner* — Patrick M Buechner
(74) *Attorney, Agent, or Firm* — Calfee, Halter & Griswold LLP

(57) ABSTRACT

A sequentially activated multi-diaphragm foam pump for a foam dispenser includes a housing with a liquid pump portion and air pump portion secured. The liquid pump portion has a liquid inlet and valve, a liquid pump diaphragm, a liquid outlet and outlet valve. The air pump portion has a first and second air inlet and air inlet valve, a first and second air pump diaphragm, and a first and second air outlet. The foam pump also includes a mixing chamber that is in fluid communication with the liquid outlet, the first second air outlets. The liquid pump diaphragm, the first and second air pump diaphragms, operate in sequential order and the foamy mixture is dispensed through an outlet that is in fluid communication with the mixing chamber.

16 Claims, 9 Drawing Sheets

(51) Int. Cl.

| | |
|---|---|
| ***B05B 7/00*** | (2006.01) |
| ***B05B 7/04*** | (2006.01) |
| ***B05B 7/24*** | (2006.01) |
| ***F04B 43/00*** | (2006.01) |
| ***F04B 43/02*** | (2006.01) |
| ***F04B 13/02*** | (2006.01) |
| ***F04B 43/04*** | (2006.01) |
| *F04B 53/10* | (2006.01) |

(52) U.S. Cl.
CPC ..... *B05B 7/2402* (2013.01); *F04B 13/02* (2013.01); *F04B 43/0045* (2013.01); *F04B 43/025* (2013.01); *F04B 43/026* (2013.01); *F04B 43/04* (2013.01); *F04B 53/10* (2013.01)

(58) Field of Classification Search
CPC ..... F04B 43/02; F04B 45/04; F04B 7/0038; F04B 7/0233; F04B 7/0275; A47K 5/12; A47K 5/14; A47K 5/16; B05B 11/3087; B05B 7/0018
See application file for complete search history.

(56) References Cited

U.S. PATENT DOCUMENTS

| | | | | |
|---|---|---|---|---|
| 4,022,351 | A | 5/1977 | Wright | |
| 4,044,923 | A | 8/1977 | Gardner | |
| 4,184,615 | A | 1/1980 | Wright | |
| 4,274,594 | A | 6/1981 | Ito | |
| 4,801,249 | A | 1/1989 | Kakizawa | |
| 5,129,550 | A | 7/1992 | Eschbach | |
| 5,635,469 | A | 6/1997 | Fowler | |
| 5,791,882 | A | 8/1998 | Stucker et al. | |
| 5,842,607 | A | 12/1998 | Snider | |
| 6,082,586 | A | 7/2000 | Banks | |
| 6,264,438 | B1 | 7/2001 | Fukami | |
| 6,382,928 | B1 * | 5/2002 | Chang | F04B 43/026 417/269 |
| 6,871,679 | B2 | 3/2005 | Last | |
| 7,040,876 | B2 | 5/2006 | Fukami et al. | |
| 7,451,687 | B2 | 11/2008 | Lynn | |
| 7,647,954 | B2 | 1/2010 | Garber et al. | |
| 7,850,049 | B2 | 12/2010 | Ciavarella et al. | |
| 7,887,304 | B2 | 2/2011 | Cal | |
| 8,272,539 | B2 | 9/2012 | Ophardt et al. | |
| 8,276,784 | B2 | 10/2012 | Ciavarella | |
| 8,449,267 | B2 | 5/2013 | Pascual | |
| 8,544,698 | B2 | 10/2013 | Ciavarella et al. | |
| 8,734,132 | B2 * | 5/2014 | Brender a Brandis | F04B 9/14 417/374 |
| 8,763,863 | B2 | 7/2014 | Quinlan et al. | |
| 8,820,585 | B1 | 9/2014 | Banks | |
| 8,845,309 | B2 | 9/2014 | Cal | |
| 8,955,718 | B2 | 2/2015 | Ciavarella et al. | |
| 8,960,498 | B2 | 2/2015 | Weglin et al. | |
| 9,341,176 | B2 | 5/2016 | Itahara | |
| 2002/0051517 | A1 | 5/2002 | Fukami | |
| 2003/0031571 | A1 | 2/2003 | Yamakawa | |
| 2003/0068234 | A1 | 4/2003 | Shindo | |
| 2003/0068242 | A1 | 4/2003 | Yamakawa | |
| 2005/0049513 | A1 * | 3/2005 | Hori | A61B 5/02 600/498 |
| 2005/0258192 | A1 * | 11/2005 | Matthews | A47K 5/14 222/190 |
| 2006/0281663 | A1 | 12/2006 | Asmus | |
| 2009/0200340 | A1 * | 8/2009 | Ophardt | A47K 5/16 222/190 |
| 2009/0294478 | A1 | 12/2009 | Ciavarella | |
| 2009/0317270 | A1 | 12/2009 | Reynolds | |
| 2010/0051642 | A1 * | 3/2010 | Wong | A47K 5/16 222/52 |
| 2010/0102083 | A1 | 4/2010 | Quinlan | |
| 2010/0270328 | A1 | 10/2010 | Quinlan | |
| 2012/0285992 | A1 | 11/2012 | Ciavarella et al. | |
| 2012/0309660 | A1 | 12/2012 | Kawasoe | |
| 2012/0315166 | A1 | 12/2012 | Looi et al. | |
| 2013/0017110 | A1 * | 1/2013 | Villagomez | F04B 43/02 417/559 |
| 2013/0032614 | A1 * | 2/2013 | Babikian | B01F 5/0693 222/190 |
| 2013/0056497 | A1 * | 3/2013 | McNulty | A47K 5/1215 222/190 |
| 2013/0175296 | A1 * | 7/2013 | Gray | A47K 5/1207 222/135 |
| 2013/0200098 | A1 * | 8/2013 | Li | A47K 5/16 222/52 |
| 2013/0206794 | A1 | 8/2013 | McNulty et al. | |
| 2013/0233441 | A1 * | 9/2013 | Ciavarella | B05B 7/0025 141/18 |
| 2014/0054322 | A1 | 2/2014 | McNulty et al. | |
| 2014/0054323 | A1 | 2/2014 | McNulty et al. | |
| 2014/0061246 | A1 | 3/2014 | McNulty | |
| 2014/0117053 | A1 | 5/2014 | Ciavarella | |
| 2014/0154117 | A1 | 6/2014 | Fukami | |
| 2014/0189992 | A1 * | 7/2014 | Ganzeboom | A47K 5/1207 29/402.08 |
| 2014/0203047 | A1 | 7/2014 | McNulty | |
| 2014/0234140 | A1 | 8/2014 | Curtis et al. | |
| 2014/0367419 | A1 | 12/2014 | Harris et al. | |
| 2015/0090737 | A1 | 4/2015 | Ciavarella | |
| 2015/0209811 | A1 | 7/2015 | Ophardt et al. | |
| 2015/0251841 | A1 | 9/2015 | McNulty et al. | |
| 2015/0266657 | A1 | 9/2015 | Corney | |
| 2015/0320266 | A1 * | 11/2015 | Creaghan | B05B 7/0037 222/190 |
| 2015/0337820 | A1 | 11/2015 | Cai | |
| 2016/0029855 | A1 | 2/2016 | Harris et al. | |
| 2016/0256016 | A1 * | 9/2016 | Yang | A47K 5/14 |
| 2017/0135531 | A1 | 5/2017 | Mak | |
| 2017/0135532 | A1 * | 5/2017 | Ciavarella | A47K 5/14 |
| 2017/0136475 | A1 * | 5/2017 | Twaroski | B05B 7/0062 |
| 2017/0143172 | A1 * | 5/2017 | Ciavarella | A47K 5/14 |
| 2017/0156550 | A1 * | 6/2017 | Ciavarella | A47K 5/14 |
| 2017/0231437 | A1 * | 8/2017 | Ciavarella | A47K 5/14 222/190 |
| 2017/0290470 | A1 * | 10/2017 | Ciavarella | A47K 5/14 |

FOREIGN PATENT DOCUMENTS

| | | | |
|---|---|---|---|
| CN | 203570550 | U | 4/2014 |
| CN | 203867833 | U | 10/2014 |
| CN | 204003387 | U | 12/2014 |
| EP | 2135538 | A1 | 12/2009 |
| EP | 3064114 | A1 | 9/2016 |
| WO | 2012154642 | A1 | 11/2012 |
| WO | 2013126696 | A2 | 8/2013 |

OTHER PUBLICATIONS

Office Action for U.S. Appl. No. 15/369,007 dated Dec. 29, 2017.
Office Action for U.S. Appl. No. 15/356,795 dated Jan. 12, 2018.
Office Action for U.S. Appl. No. 15/350,190 dated Dec. 18, 2017.

* cited by examiner

SEQUENTIALLY ACTIVATED MULTI-DIAPHRAGM FOAM PUMPS, REFILL UNITS AND DISPENSER SYSTEMS

RELATED APPLICATIONS

The present invention claims the priority to, and the benefits of, U.S. Provisional Patent Application, Ser. No. 62/254,430, filed on Nov. 12, 2015 and titled SEQUENTIALLY ACTIVATED MULTI-DIAPHRAGM FOAM PUMPS, REFILL UNITS AND DISPENSER SYSTEMS, which is incorporated herein by reference in its entirety.

TECHNICAL FIELD

The present invention relates generally to pumps, refill units for dispenser systems, and more particularly to sequentially activated multi-diaphragm foam pumps for mixing liquid soap, sanitizer, or lotion with air to create and dispense a foam product.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles.

SUMMARY

The present application discloses exemplary embodiments of sequentially activated multi-diaphragm foam pumps and dispenser systems having sequentially activated multi-diaphragm foam pumps.

An exemplary sequentially activated multi-diaphragm foam pump for a foam dispenser includes a housing with a liquid pump portion and air pump portion secured to the housing. The liquid pump portion has a liquid inlet, a liquid inlet valve, a liquid pump diaphragm, a liquid outlet valve, and a liquid outlet. The air pump portion has a first and second air inlet, a first and second air inlet valve, a first and second air pump diaphragm, and a first and second air outlet. The exemplary sequentially activated multi-diaphragm foam pump also includes a mixing chamber that is in fluid communication with the liquid outlet, the first air outlet, and the second air outlet. The liquid pump diaphragm, the first air pump diaphragm, and the second air pump diaphragm operate in sequential order. The liquid pump diaphragm pumps liquid into the mixing chamber, the first air pump diaphragm pumps air into the mixing chamber to mix with the liquid to form a liquid air mixture, and the second air pump diaphragm pumps air into the mixing chamber to mix with the liquid air mixture to form a foamy mixture. The foamy mixture is dispensed through an outlet that is in fluid communication with the mixing chamber.

An exemplary foam dispenser includes a housing, a motor, a wobble plate, a receptacle for receiving a refill unit, a refill unit having a connector for connecting to the receptacle, a sequentially activated multi-diaphragm foam pump, a foam cartridge, and a foam outlet. The sequentially activated multi-diaphragm foam pump has a liquid pump diaphragm for pumping liquid into a mixing chamber, a first air pump diaphragm for pumping air into the mixing chamber, and a second air pump diaphragm for pumping air into the mixing chamber. The rotation of the wobble plate causes a sequential compression of the liquid pump diaphragm, the first air pump diaphragm, and the second air pump diaphragm. The foam cartridge is located downstream of the mixing chamber, and the foam outlet is located downstream of the foam cartridge.

Another exemplary foam dispenser includes a housing, a motor, a wobble plate, a reservoir containing a foamable fluid, a sequentially activated multi-diaphragm foam pump, an eccentric wobble plate drive member, a mixing chamber, a foam cartridge, and an outlet. The sequentially activated multi-diaphragm foam pump has a plurality of diaphragm pump chambers, and each diaphragm pump chamber is connected to the wobble plate. Rotation of the eccentric wobble plate drive member causes the wobble plate to sequentially compress and sequentially expand the plurality of diaphragm pump chambers. The mixing chamber is located downstream of the plurality of diaphragm pumping chambers, and liquid and air mix in the mixing chamber thereby creating a liquid air mixture. The foam cartridge creates a foam from the liquid air mixture, and the foam is dispensed from the outlet.

DETAILED DESCRIPTION

The present application discloses exemplary embodiments of sequentially activated multi-diaphragm foam pumps. Some exemplary embodiments include a wobble plate and three or more pump diaphragms. The three or more pump diaphragms include at least one liquid pump diaphragm and at least two air pump diaphragms. Each liquid pump diaphragm has a liquid inlet for receiving liquid, such as, for example, a soap, a sanitizer, or a lotion, and each air pump diaphragm has an air inlet for receiving a gas, such as, for example, ambient air. The three or more pump diaphragms operate sequentially, and each pump diaphragm operates once in an exemplary operating cycle. An operating cycle begins with the operation of a liquid pump diaphragm. Additionally, the sequentially activated multi-diaphragm foam pump includes a mixing chamber. Each liquid pump diaphragm pumps liquid into the mixing chamber, and each air pump diaphragm pumps ambient air into the mixing chamber. The liquid mixes with the ambient air in the mixing chamber to create a foam mixture that is dispensed out of the pump outlet. In some embodiments, the foam mixture has an air to liquid ratio of about 2 to 1. In some embodiments, the air to liquid ratio is about 3 to 1.

The sequentially activated multi-diaphragm foam pumps may be used in foam dispensers. An exemplary foam dispenser comprises a housing, a motor, a refill unit, a sequentially activated multi-diaphragm foam pump, and a foam cartridge. The pump receives a foamable liquid from the refill unit, mixes the foamable liquid with ambient air to create a foam mixture, forces the foam mixture through the foam cartridge to enrich the foam, and dispenses the foam to a user.

Figure 1:
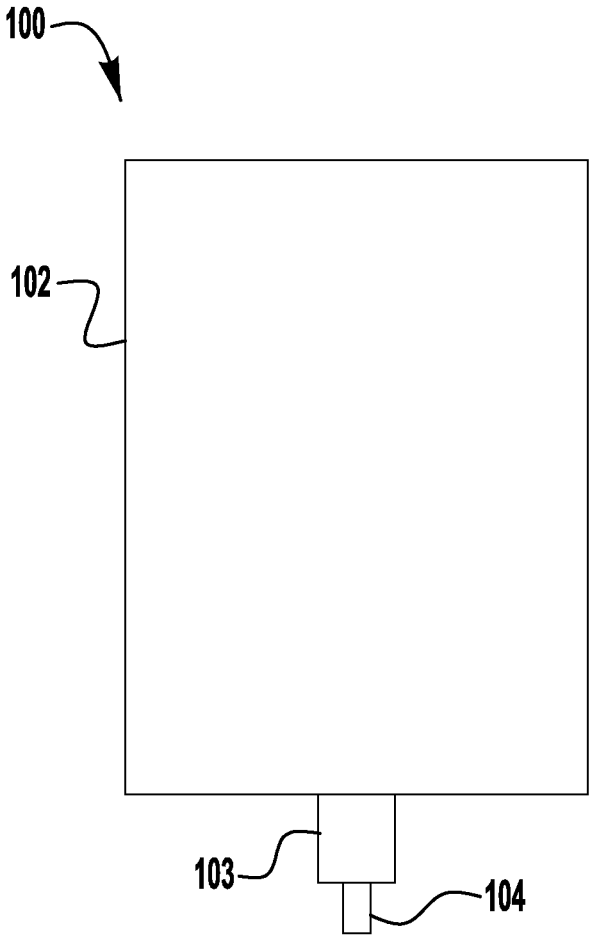
FIG. 1 is an exemplary embodiment of a refill unit for a foam dispenser.

FIG. 1 illustrates a refill unit 100 for a foam dispenser. The refill unit 100 includes a collapsible container 102. Collapsible container 102 includes a neck 103 and a drip-free quick connector 104. Exemplary drip-free quick connectors are disclosed in U.S. Pat. No. 6,871,679 titled Bag and Dispensing System Comprising Such A Bag, and U.S. Pat. No. 7,647,954 titled Connector Apparatus And Method For Connecting The Same For Controlling Fluid Dispensing, which are incorporated herein by reference in their entirety. Disposable refill units contain a supply of a foamable liquid. In various embodiments, the contained foamable liquid could be for example a soap, a sanitizer, a cleanser, a disinfectant, a lotion or the like. The container is a collapsible container and can be made of thin plastic or a flexible bag-like material. In other embodiments, the container may be a non-collapsing container formed by a rigid housing member, or any other suitable configuration for containing the foamable liquid without leaking. In the case of a non-collapsing container, a vent system may be included. Exemplary venting systems are disclosed in U.S. Patent Applications Publication No. 2015/0266657 titled Closed system for venting a dispenser reservoir; Publication No. 2015/025184 titled Pumps With Container Vents and application Ser. No. 14/811,995, titled Vented Refill Units And Dispensers Having Vented Refill Units, which are incorporated herein by reference.

Figure 2:
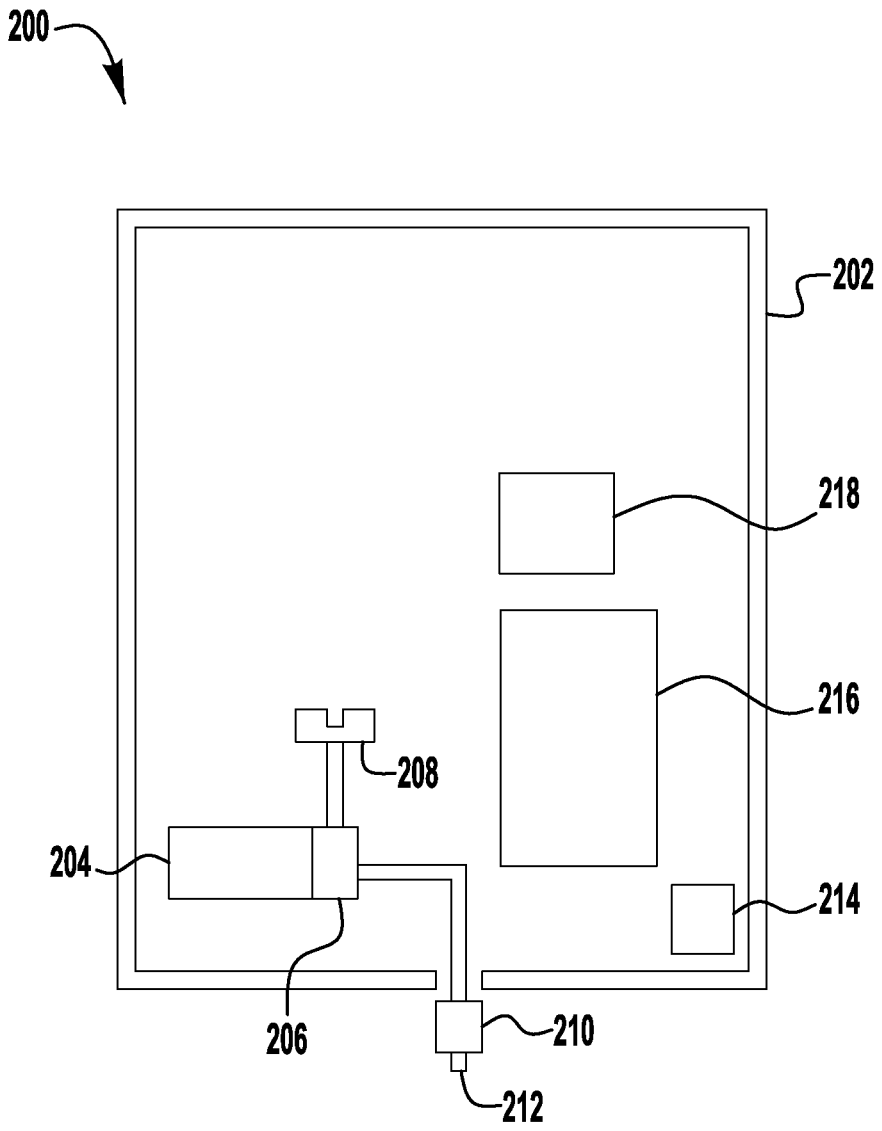
FIG. 2 is an exemplary embodiment of a foam dispenser.
Figure 2A:
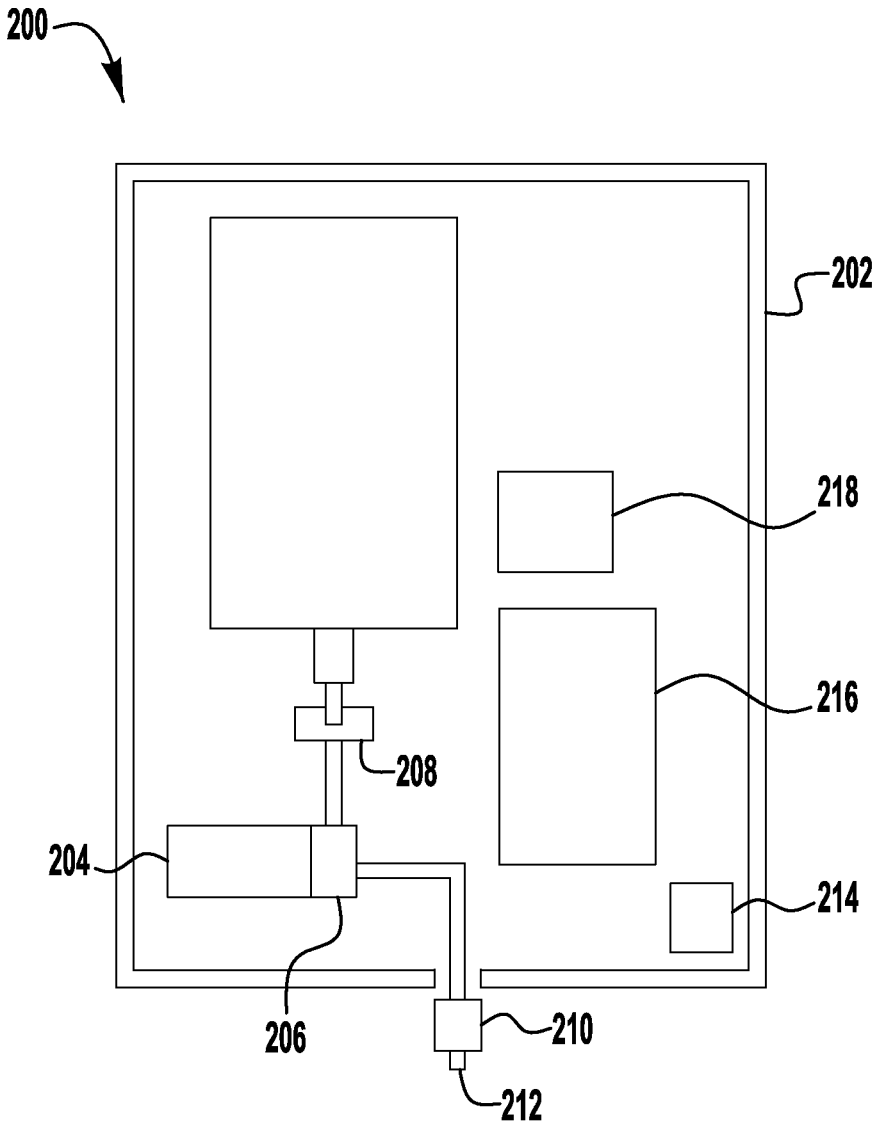
FIG. 2A is the exemplary foam dispenser of FIG. 2 with the exemplary refill unit of FIG. 1 installed.

FIG. 2 illustrates an exemplary embodiment of a touch-free foam dispenser 200. The touch-free foam dispenser 200 includes a housing 202, a motor 204, a foam pump 206, a refill unit connector 208, a foam cartridge 210, and a nozzle 212. Exemplary embodiments of foam cartridges 210 are shown and described in U.S. Publication No. 20140367419, which is incorporated herein in its entirety by reference. A refill unit 100 may be connected to the refill unit connector 208 as shown in FIG. 2A. The refill unit 100 contains a foamable liquid, such as a soap, a sanitizer, a lotion, a cleanser, a disinfectant or the like. The touch-free foam dispenser 200 is activated when sensor 214 detects the presence of a user or object. Upon detection of an object or user, the sensor 214 provides a signal to the processor (not shown) in the electronic control board 216. The electronic control board 216 provides an output signal that causes the motor 204 to rotate an eccentric wobble plate actuator drive mechanism 301. The sensor 214 and the electronic control board 216 receive power from a power source 218. In some embodiments, the motor 204 receives power from the power source 218, and, in other embodiments, the refill unit includes a power source (not shown) that provides power to a rechargeable power source (not shown). Exemplary embodiments of refill units with power supplies that provide power to the wobble plate actuator drive mechanism 301 are shown and described in U.S. Publication No. 2014/0234140 titled Power Systems For Touch Free Dispensers And Refill Units Containing A Power Source, which is incorporated herein in its entirety by reference. Providing power to the motor 204 causes wobble plate actuator drive mechanism 301 to rotate. Rotation of wobble plate actuator drive mechanism 301 sequentially compresses and expands the diaphragms of foam pump 206 and pumps liquid and ambient air into mixing chamber. The liquid and air mix together and form a foam mixture. The foam mixture is forced through the foam cartridge 210, which creates a rich foam. The rich foam is dispensed from the foam dispenser 200 through the nozzle 212.

The refill unit 100 and the foam dispenser 200 illustrated in FIGS. 1 and 2, respectively, are drawn generically because a variety of different components may be used for many of the refill unit 100 and the foam dispenser 200. Although foam pump 206 is illustrated generically above, it is described in detail below. Some exemplary dispenser components that may be used in accordance with the present invention are shown and described in U.S. Pat. No. 8,960,498 titled Touch-Free Dispenser With Single Cell Operation And Battery Banking; U.S. Pat. Pub. No. 2014/00543.22 titled Off-Axis Inverted Foam Dispensers And Refill Units and Pub. No. 2014/0234140 titled Power Systems For Touch Free Dispensers And Refill Units Containing A Power Source, which are incorporated herein by reference in their entirety.

Figure 3:
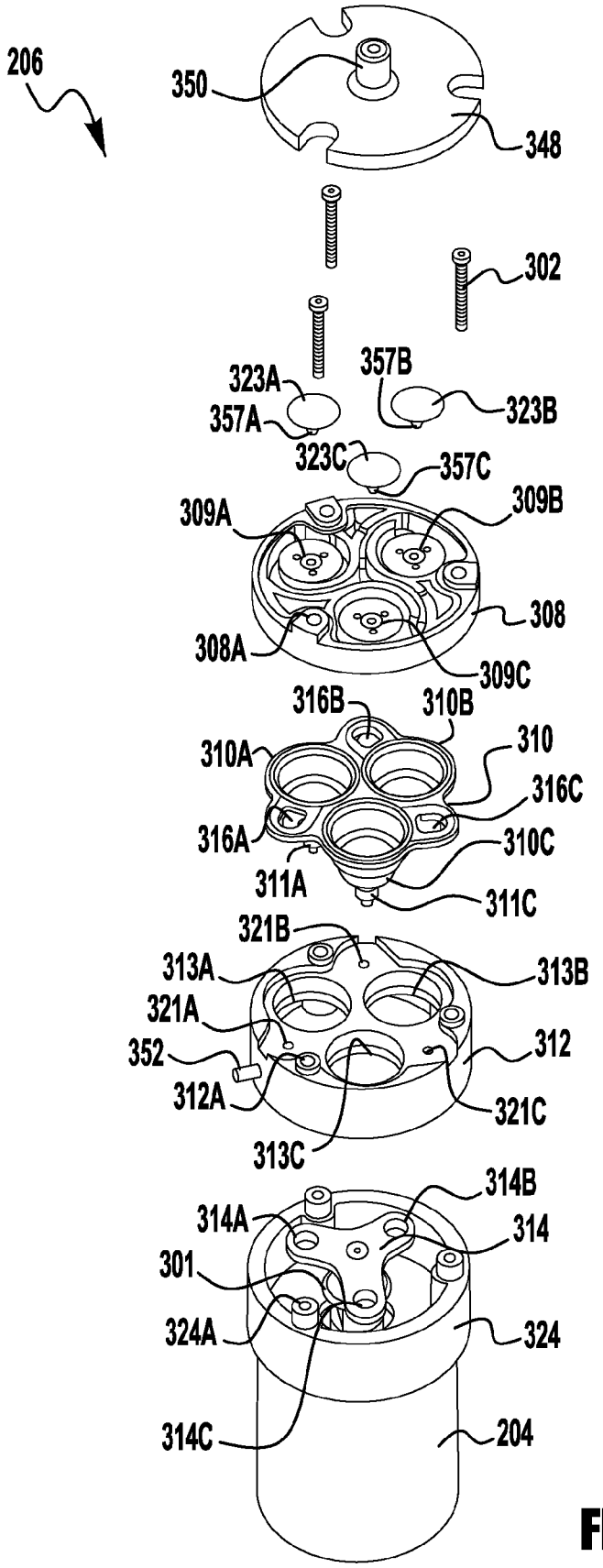
FIG. 3 is an exploded view of an exemplary embodiment of a sequentially activated multi-diaphragm foam pump taken from a first perspective.

FIG. 3 is an exploded view of an exemplary embodiment of foam pump 206. Foam pump 206 is driven by motor 204. Foam pump 206 includes a pump base 324, a wobble plate 314, a diaphragm assembly seat 312, a diaphragm assembly 310, a valve seat 308, outlet valves 323A, 323B, 323C, screws 302, and a cover 348. The valve seat 308, diaphragm assembly seat 312, and pump base 324 are secured together by screws 302 in screw holes 308A, 312A, 324A. The cover 348 is attached to the valve seat 308. Outlet valves 323A, 323B 323C are secured to and seated in the valve seat 308.

The diaphragm assembly 310 includes three pump diaphragms 310A, 310B, 310C, and each pump diaphragm 310A, 310B, 310C has a connector 311A, 311B, 311C. The diaphragm assembly 310 is located in the diaphragm assembly seat 312. The pump diaphragms 310A, 310B, 310C are disposed in the receiving holes 313A, 313B, 313C of the diaphragm assembly seat 312, and the three connectors 311A, 311B, 311C connect to the wobble plate 314 by inserting the three connectors 311A, 311B, 311C in the three wobble plate apertures 314A, 314B, 314C.

Ambient air enters the foam pump 206 through pump air inlet 424B (FIG. 4), and liquid, such as for example, foamable soap or sanitizer enters the foam pump 206 through liquid inlet 352. Two of the pump diaphragms 310B, 310C receive ambient air, and the other pump diaphragm 310A receives foamable liquid, such as, for example soap or sanitizer.

Figure 4:
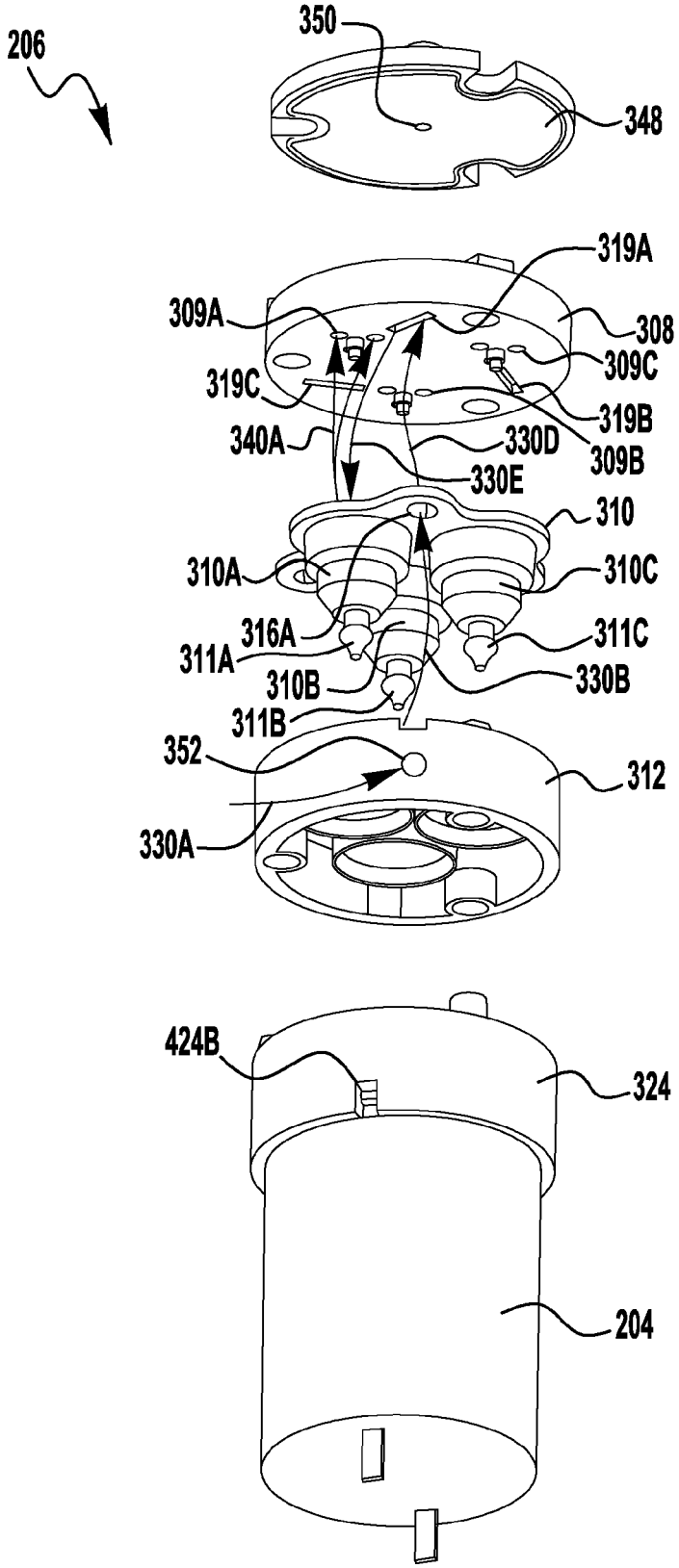
FIG. 4 is an exploded view of the exemplary embodiment of the sequentially activated multi-diaphragm foam pump of FIG. 3 taken from a second perspective.

FIG. 4 is another exploded view of the exemplary foam pump 206 from a different perspective. As described above, the diaphragm assembly 310 includes three pump diaphragms 310A, 310B, 310C. Each pump diaphragm 310A, 310B, 310C has a corresponding inlet valve 316A, 316B, 316C (better seen in FIGS. 5 and 6). FIG. 4 also provides a view of the bottom of the valve seat 308. The bottom of valve seat 308 has three areas that correspond to the three pump diaphragms 310A, 310B, 310C. Each area has three fluid outlet apertures 309A, 309B, 309C that extend through valve seat 308, a valve stem retention aperture 329A, 329B, 329C (FIG. 7), and a fluid inlet groove 319A, 319B, 319C. The fluid inlet grooves 319A, 319B, 319C do not extend through valve seat 308.

Figure 5:
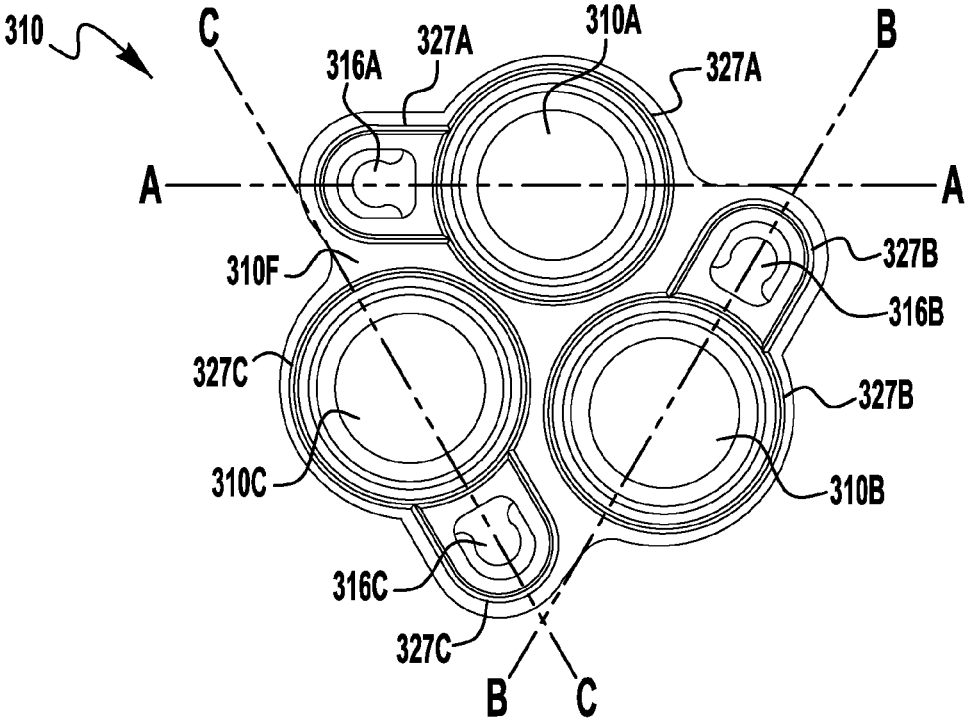
FIG. 5 is a top view of an exemplary diaphragm assembly for the exemplary embodiment of the sequentially activated multi-diaphragm foam pump of FIG. 3.
Figure 6:
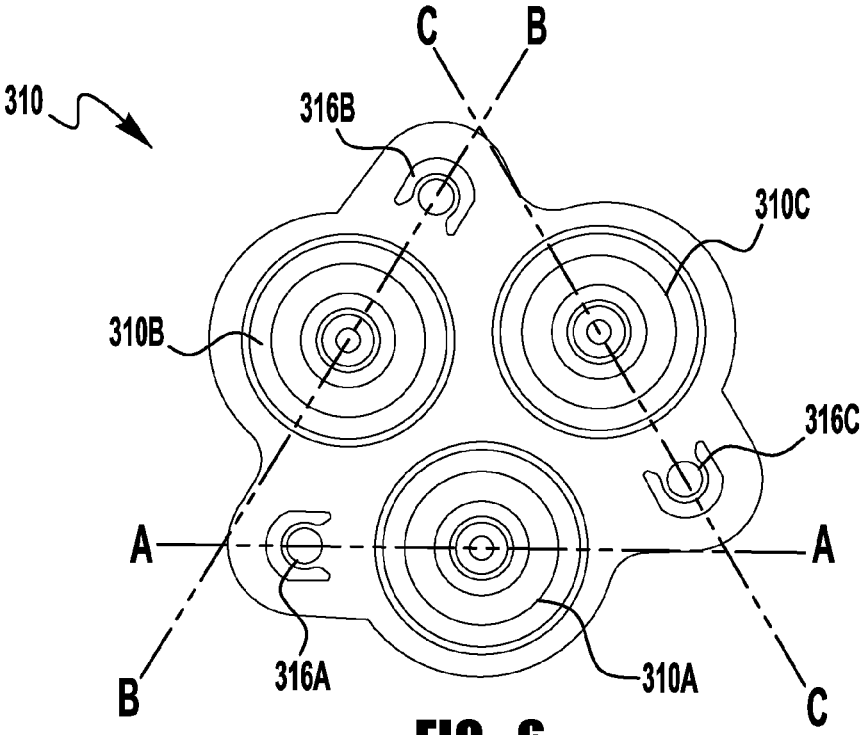
FIG. 6 is a bottom view of the exemplary diaphragm assembly of FIG. 5.

FIGS. 5 and 6 illustrate a top view and a bottom view, respectively, of the exemplary diaphragm assembly 310 for foam pump 206. In some embodiments, the diaphragm assembly is made of natural rubber, EPDM, Silicone, Silicone rubber TPE, TPU, TPV, vinyl, or the like. The diaphragm assembly 310 includes three molded pump diaphragms 310A, 310B, 310C and three corresponding inlet valves 316A, 316B, 316C. The top of the diaphragm assembly 310 acts as a sealing gasket. The top of the diaphragm assembly 310 has a flat section 310F, and each pump diaphragm 310A, 310B, 310C has gasket walls 327A, 327B, 327C that surround the respective valves 316A, 316B, 316C and pump diaphragms 310A, 310B, 310C. The gasket walls 327A, 327B, 327C seal against the bottom of the valve seat 308 (FIG. 4 and FIG. 8) to prevent fluid, such as, air and liquid soap or sanitizer from leaking out of the foam pump 206 at a location other than the pump outlet 350 (FIG. 3). One-way inlet valves 316A, 316B, 316C allow ambient air, liquid soap, or sanitizer to enter the pump diaphragms 310A, 310B, 310C when the pump diaphragms 310A, 310B, 310C have a negative pressure (i.e., when the pump diaphragms 310A, 310B, 310C are expanding), and seal against inlet apertures 321A, 321B, 321C when the pump diaphragms 310A, 310B, 310C have a positive pressure (e.g. when the pump diaphragms 310A, 310B, 310C are compressing). The one-way inlet valves 316A, 316B, 316C are formed by flexible tabs and are made of the same material as the diaphragm assembly 310.

Figure 7:
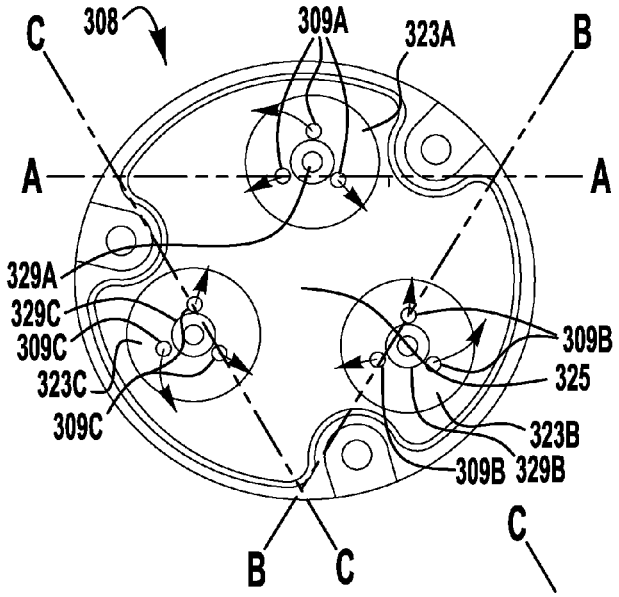
FIG. 7 is a top view of an exemplary valve seat for the exemplary embodiment of the sequentially activated multi-diaphragm foam pump of FIG. 3.

FIG. 7 is a top view of an exemplary valve seat 308 for the foam pump 206. One-way liquid outlet valve 323A is shown transparently to more clearly illustrate the flow of liquid 331A through liquid outlet apertures 309A and into mixing chamber 325. One-way liquid outlet valve 323A includes a valve stem 357A (FIG. 3) that is inserted into aperture 329A to secure one-way liquid outlet valve 323A to valve seat 308. One-way liquid outlet valve 323A is normally closed and prevents air or liquid from flowing from the mixing chamber 325, back through liquid outlet apertures 309A, and into liquid pump diaphragm 310A. One-way liquid outlet valve 323 opens when liquid pump diaphragm 310A is being compressed to pump fluid.

Similarly, one-way air outlet valves 323B, 323C are shown transparently to more clearly illustrate the flow of air 331B, 331C through air outlet apertures 309B, 309C and into mixing chamber 325. One-way air outlet valves 323B, 323C each include a valve stem 357B, 357C (FIG. 3) that are inserted into corresponding apertures 329B, 329C to secure the one-way air outlet valves to valve seat 308. One-way air outlet valves 323B, 323C are normally closed and prevent air or liquid from flowing from the mixing chamber 325, back through air outlet apertures 323B, 323C, and into air pump diaphragms 310B, 310C. One-way air outlet valves 323B, 323C open when corresponding air pump diaphragms 310B, 310C are being compressed to pump air.

Figure 8:
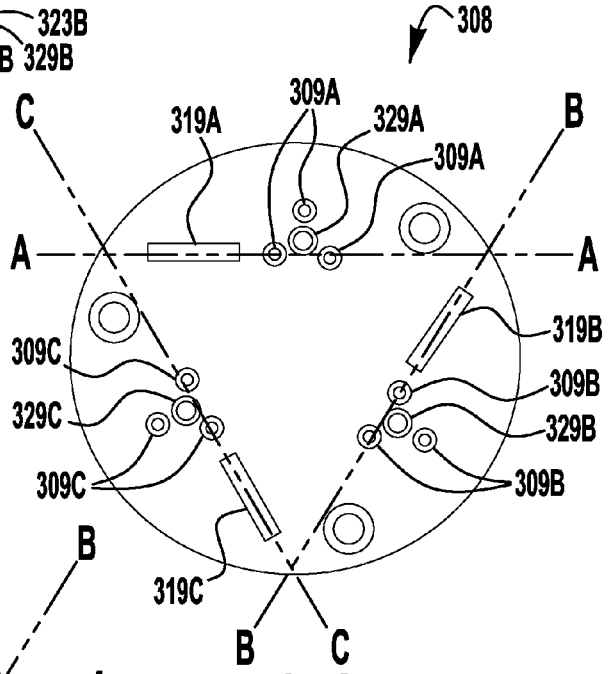
FIG. 8 is a bottom view of the exemplary valve seat of FIG. 7.

FIG. 8 is a bottom view of the exemplary valve seat 308 for the foam pump 206. The valve seat 308 includes three liquid outlet apertures 309A that pass through valve seat 308 and a liquid outlet valve aperture 329A for retaining one-way liquid outlet valve 323A. Valve seat 308 also includes a liquid inlet groove 319A that extends partially into valve seat 308 to provide a liquid path from one-way liquid inlet valve 316A to the interior of liquid pump diaphragm 310A. In addition, the valve seat 308 includes a first set of three air outlet apertures 309B that pass through valve seat 308, and a second set of three air outlet apertures 309C that pass through valve seat 308. Also, valve seat 308 includes air outlet valve apertures 329B, 329C for retaining one-way air outlet valves 323B, 323C, and air inlet grooves 319B, 319C that extend partially into valve seat 308 to provide an air path from one-way air inlet valves 316B, 316C to the interior of air pump diaphragms 310B, 310C.

Figure 9:
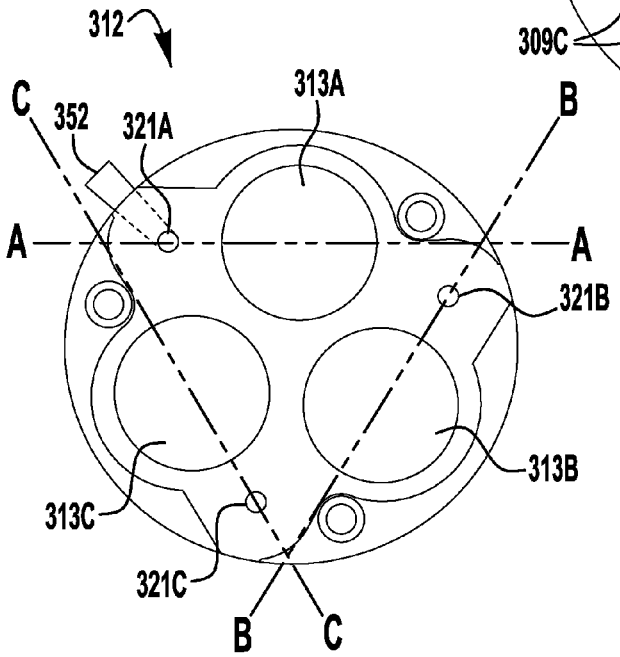
FIG. 9 is a top view of an exemplary diaphragm assembly seat for the exemplary embodiment of the sequentially activated multi-diaphragm foam pump of FIG. 3.

FIG. 9 is a top view of an exemplary diaphragm assembly seat 312 for the exemplary embodiment of a foam pump 206. The diaphragm assembly seat 312 includes three receiving holes 313A, 313B, 313C and three inlet apertures 321A, 321B, 321C. In fluid communication with inlet aperture 321A is liquid inlet 352 which may be coupled to the liquid outlet of container 102. Each receiving hole 313A, 313B, 313C is sized to receive a diaphragm 310A, 310B, 310C. Each inlet aperture 321A, 321B, 321C extends through diaphragm assembly seat 312 and allows either ambient air, liquid soap, or sanitizer to enter one of the diaphragms 310A, 310B, 310C.

Figure 10A:
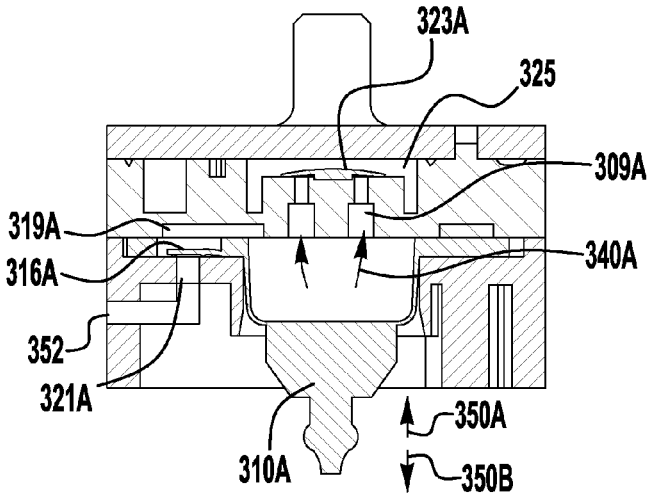
FIG. 10A is a cross-sectional view taken along the lines A-A of FIGS. 5-9 of a liquid pump portion of the sequentially activated multi-diaphragm foam pump of FIG. 3.

FIG. 10A is a cross-sectional view taken along the lines A-A of FIGS. 5-9 showing the liquid pump portion of foam pump 206. In operation, liquid pump diaphragm 310A is moved downward, as shown by reference number 350B, to expand pump chamber 1002, which causes liquid inlet valve 316A to open allowing liquid to be drawn into pump chamber 1002 through liquid inlet 352, inlet aperture 321A, and liquid inlet groove 319A. Once the pump chamber 1002 is expanded it is primed with liquid, such as, for example, liquid soap or sanitizer. When the liquid pump diaphragm 310A is compressed (i.e. the liquid pump diaphragm 310A moves in the direction shown by reference number 350A), the liquid is pumped in the direction shown by reference number 340A. The liquid travels through liquid outlet apertures 309A, past one-way liquid outlet valve 323A and into mixing chamber 325. One-way liquid outlet valve 323A is normally closed, but one-way liquid outlet valve 323A opens due to pressure caused by compressing liquid pump chamber 1002. One-way liquid outlet valve 323A prevents air or liquid from flowing back through liquid outlet apertures 309A and into liquid pump diaphragm 310A. Subsequently, the liquid pump diaphragm 310A begins to expand, which starts the process again by causing liquid inlet valve 316A to open, and liquid is drawn into liquid pump chamber 1002 through liquid inlet aperture 321A and liquid inlet groove 319A. A operating cycle of foam pump 206 includes one pump of liquid from liquid pump diaphragm 310A through liquid outlet apertures 309A, past liquid outlet valve 323A, and into mixing chamber 325 (FIG. 7) (followed by two pumps of air as described below).

Figure 10B:
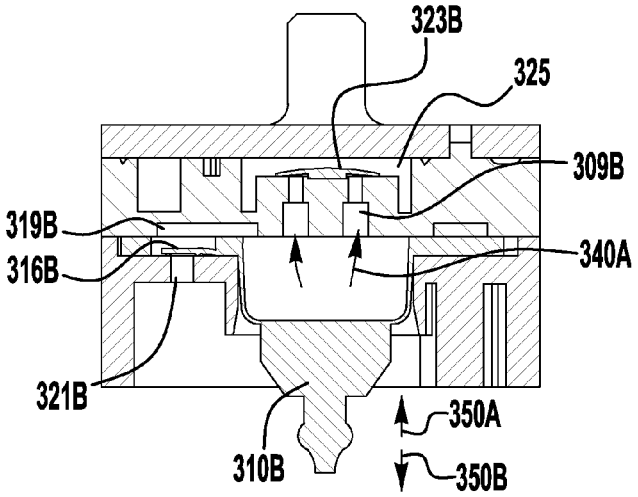
FIG. 10B is a cross-sectional view taken along the lines B-B of FIGS. 5-9 of a first air pump portion of the sequentially activated multi-diaphragm foam pump of FIG. 3.
Figure 10C:
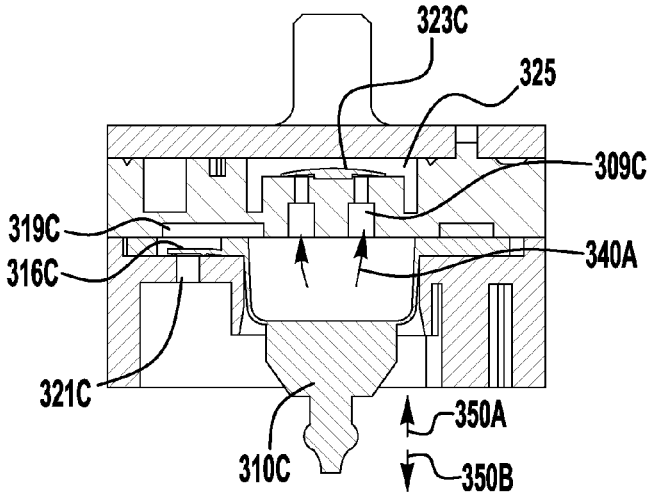
FIG. 10C is a cross-sectional view taken along the lines C-C of FIGS. 5-9 of a second air pump portion of the sequentially activated multi-diaphragm foam pump of FIG. 3.

FIGS. 10B and 10C are a cross-sectional view taken along the lines B-B and C-C, respectively, of FIGS. 5-9 showing the air pump portions of foam pump 206. In operation, air pump diaphragms 310B, 310C are moved downward, as shown by reference number 350B, to expand air pump chambers 1004, 1006, which causes air inlet valves 316B, 316C to open allowing ambient air to be drawn into pump chambers 1004, 1006 through air inlet apertures 321B, 321C and air inlet grooves 319B, 319C. Once the pump chambers 1004, 1006 are primed with air, the air pump diaphragms 310B, 310C may be compressed (moved in the direction shown by reference number 350A). Compression of air pump diaphragms 310B, 310C pump the air in the direction shown by reference number 340A. The air travels through air outlet apertures 309B, 309C, past one-way air outlet valves 323B, 323C, and into mixing chamber 325 to mix with the foamable liquid. One-way air outlet valves 323B, 323C are normally closed, but one-way air outlet valves 323B, 323C open due to pressure caused by compressing air pump chambers 1004, 1006. One-way air inlet valves 323B, 323C prevent air or liquid from flowing back through air outlet apertures 309B, 309C and into air pump diaphragms 310B, 310C. Subsequently, the air pump diaphragms 310B, 310C begin to expand, which starts the process again by causing air inlet valves 316B, 316C to open, and ambient air is drawn into air pump chambers 1004, 1006 through air inlet apertures 321B, 321C and air inlet grooves 319B, 319C. An operating cycle of foam pump 206 includes one pump of liquid (as described above) followed by one pump of air from air pump diaphragm 310B through air outlet apertures 309B, past air outlet valve 323B, and into mixing chamber 325 (FIG. 7). In addition, an operating cycle of foam pump 206 includes one pump of ambient air from air pump diaphragm 310C through air outlet apertures 309C, past air outlet valve 323C, and into mixing chamber 325 (FIG. 7).

The diaphragms 310A, 310B, 310C operate sequentially, in which one sequence of operation includes one pump of liquid, such as, for example, soap or sanitizer, or ambient air by each of the three pump diaphragms 310A, 310B, 310C. The order of operation of the pump diaphragms 310A, 310B, 310C is dependent upon the configuration of the wobble plate 314 (FIG. 3). As shown in FIG. 3, each pump diaphragm 310A, 310B, 310C has a connector 311A, 311B, 311C, and the three pump diaphragms 310A, 310B, 310C connect to the wobble plate 314 by inserting the three connectors 311A, 311B, 311C in the three wobble plate links 314A, 314B, 314C. Wobble plate 314 connects to an eccentric wobble plate actuator that causes the wobble plate 314 to undulate. As the wobble plate 314 undulates, the wobble plate links 314A, 314B, 314C move in upward and downward motions. The upward motion causes the pump diaphragms 310A, 310B, 310C to compress, and the downward motion causes the pump diaphragms 310A, 310B, 310C to expand. The configuration of the wobble plate 314 causes one pump diaphragm 310A, 310B, 310C to compress at a time, which causes the pump diaphragms 310A, 310B, 310C to pump sequentially. The configuration of the wobble plate 314 also causes one pump diaphragm 310A, 310B, 310C to expand at a time, which causes the pump diaphragms 310A, 310B, 310C to prime sequentially. In the exemplary sequence of operation, the liquid pump diaphragm 310A pumps a shot of fluid, followed by air pump diaphragm 310B pumping a shot of air, and the sequence of operation ends with air pump diaphragm 310C pumping a second shot of air. The sequence may be repeated any number of times depending on the desired output dose of foam. The air from the air pump diaphragms 310B, 310C mixes with either the liquid or sanitizer from the liquid pump diaphragm 310A in the mixing chamber 325 (FIG. 7), which creates a foam mixture. The foam mixture exits the foam pump 206 through the pump outlet 350.

FIG. 4 illustrates the flow path of the liquid soap or sanitizer through the exploded view. When the liquid pump diaphragm 310A expands, liquid enters the foam pump 206 through liquid inlet 352, which is shown by reference number 330A. The liquid travels through aperture 321A in the diaphragm assembly seat 312, and past liquid one-way inlet valve 316A, as shown by reference number 330B. Inlet valve 316A opens, the liquid travels through groove 319A and into liquid pump diaphragm 310A, which is shown by reference numbers 330D and 330E.

The liquid pump diaphragm 310A compresses and pumps the liquid through liquid outlet aperture 309A, past one-way liquid outlet valve 323A, and into the mixing chamber 325 (FIG. 7), which is shown by reference number 340A. Air follows a similar path for air pump diaphragms 310B, 310C. When air pump diaphragms 310B, 310C expand, air is drawn into air inlet 424B, travels through apertures 321B, 321C (FIG. 9) in diaphragm seat assembly 312, travels through one-way air inlet valves 316B, 316C (FIGS. 5 and 6), travels into grooves 319B, 319C, in the bottom of valve seat 308, and travels into air pump diaphragms 310B, 310C. When air pump diaphragms 310B, 310C compress, air is forced through apertures 309B, 309C, past one-way air outlet valves 323B, 323C (FIG. 7), and into mixing chamber 325 where it mixes with the liquid to form a foam mixture. The foam mixture is dispensed through outlet 350, which is shown by reference number 304B.

Figure 11:
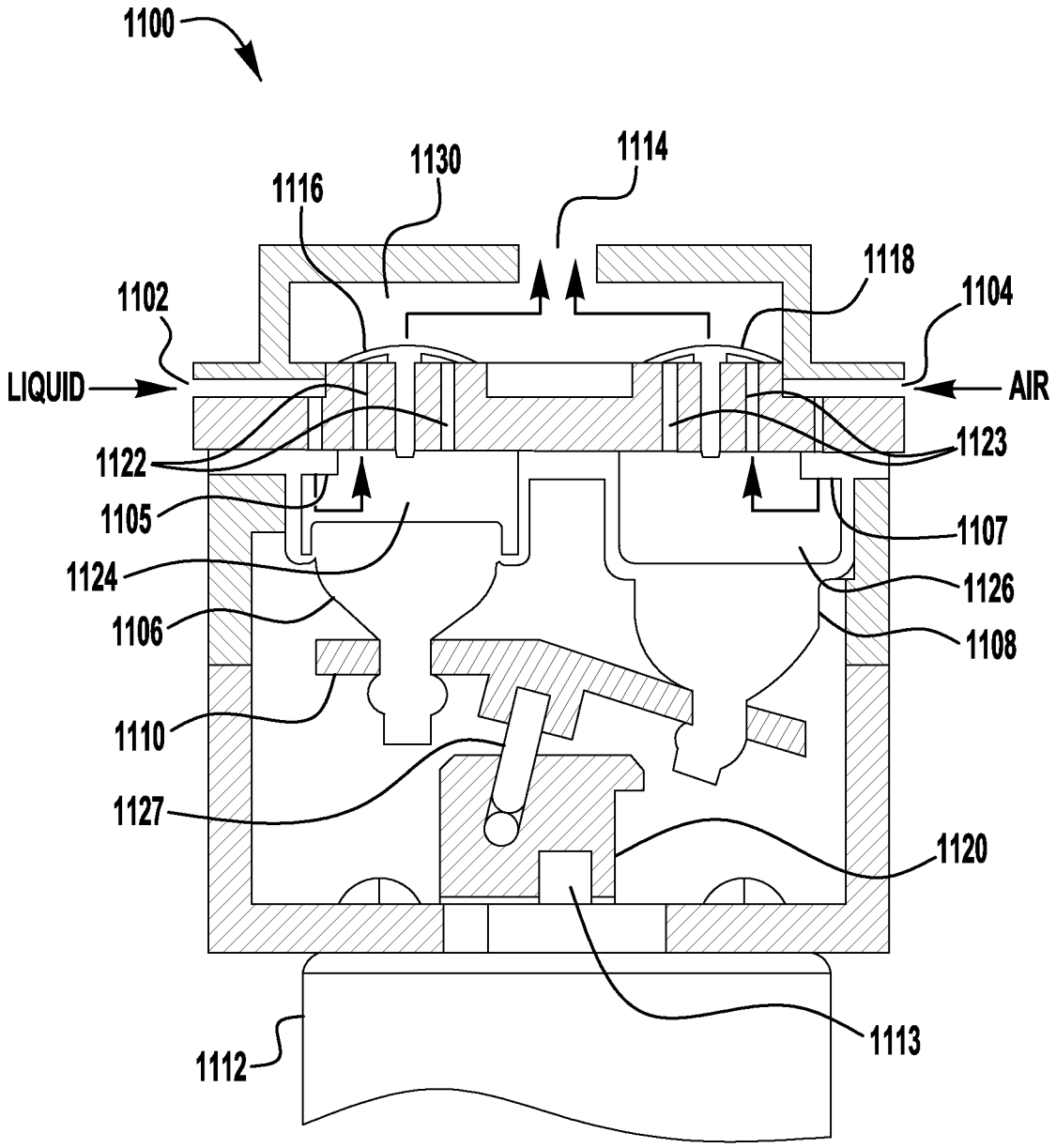
FIG. 11 is a cross-sectional view of another exemplary embodiment of a sequentially activated multi-diaphragm foam pump.

FIG. 11 is a cross-sectional view of another exemplary embodiment of a sequentially activated multi-diaphragm foam pump 1100. The sequentially activated multi-diaphragm foam pump 1100 includes a motor 1112, a motor shaft 1113, a wobble plate 1110, a wobble plate pin 1127 an eccentric wobble plate drive 1120, a liquid pump diaphragm 1106, two air pump diaphragms 1108 (only one is shown), mixing chamber 1130, and pump outlet 1114. The motor 1112 drives the motor shaft 1113, which causes the motor shaft 1113 to rotate. The rotation of the motor shaft 1113 causes the eccentric wobble plate drive 1120 to rotate, and rotation of the eccentric wobble plate drive 1120 causes the wobble plate pin 1127 to move along a circular path, which causes the wobble plate 1110 to undulate. In some embodiments, wobble plate 314 includes a ball 1128 that rides in a socket (not shown) on the pump housing and wobble plate pin 127 extends outward and connects to an eccentric wobble plate actuator 1120 that causes the pin to move along a circular path which causes the wobble plate 1110 to undulate. As the wobble plate 1110 undulates, the ends connected to the three pump diaphragms 1106, 1108 move in upward and downward motions, and the three pump diaphragms 1106, 1108 are compressed sequentially. One sequence of operation of the mixing pump 1100 includes one pump by each of the three pump diaphragms 1106, 1108. The liquid pump diaphragm 1106 operates first in the cycle of operation, followed by sequential distributions by the two air pump diaphragms 1108.

Similar to the embodiments described above, during operation, the liquid pump diaphragm 1106 expands and contracts to pump liquid, and the air pump diaphragms 1108 (only one is shown) expand and contract to pump air. The expansion of the liquid pump diaphragm 1106 opens the liquid inlet valve 1105 and allows liquid, such as, for example, soap or sanitizer to enter liquid pump chamber 1124 through liquid inlet 1102. The expansion of the air pump diaphragms 1108 opens the air inlet valves 1107 (only one is shown) and allows air to enter air pump chambers 1126 (only one is shown) through air inlets 1104. Circular movement of the wobble plate pin 1127 causes the ends of the wobble plate 1110 to sequentially undulate. The undulation causes liquid pump diaphragm to compress, which causes liquid outlet valve 1116 to open, and liquid to flow into the mixing chamber 1130 through liquid outlet apertures 1122. Subsequently, one of the air pump diaphragms 1108 is compressed by the undulating wobble plate 1110, which causes air outlet valve 1118 to open, and air to flow the mixing chamber 1130 through air outlet apertures 1123. Then, the other air pump diaphragm (not shown) will compress and pump air into mixing chamber 1130. The air and liquid soap or sanitizer mix in the mixing chamber 1130 to create a foam mixture. The foam mixture exits the mixing pump 1100 through pump outlet 1114.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

The invention claimed is:

1. A sequentially activated multi-diaphragm foam pump for a foam dispenser comprising:
- a housing;
- a liquid pump portion secured to the housing;
  - the liquid pump portion having:
    - a liquid inlet; a liquid inlet valve; a liquid pump diaphragm; a liquid outlet valve; and a liquid outlet;
- an air pump portion secured to the housing;
  - the air pump portion having:
    - a first air inlet, a first air inlet valve, a first air pump diaphragm and a first air outlet; and
    - a second air inlet, a second air inlet valve, a second air pump diaphragm and a second air outlet;
  - wherein the liquid pump diaphragm, the first air pump diaphragm and the second air pump diaphragm are formed in a unitary resilient member;
- a mixing chamber in fluid communication with the liquid outlet, the first air outlet and the second air outlet;
- wherein the liquid pump diaphragm, the first air pump diaphragm, and the second air pump diaphragm operate in sequential order;
- wherein the liquid pump diaphragm pumps a shot of liquid into the mixing chamber;
- wherein the first air pump diaphragm pumps a shot of air into the mixing chamber to mix with the liquid to form a liquid air mixture; and
- wherein the second air pump diaphragm pumps a shot of air into the mixing chamber to mix with the liquid air mixture to form a foamy mixture; and
- an outlet for dispensing foam.

2. The sequentially activated multi-diaphragm foam pump of claim 1 wherein the liquid inlet valve, the air inlet valve, and the second air inlet valve are formed in the unitary resilient member.

3. The sequentially activated multi-diaphragm foam pump of claim 1 wherein the outlet is on a longitudinal axis and the liquid pump diaphragm, first air pump diaphragm and second air pump diaphragm are concentric about the longitudinal axis.

4. The sequentially activated multi-diaphragm foam pump of claim 1 further comprising a wobble plate, wherein the wobble plate rotates and compresses the liquid pump diaphragm, first air pump diaphragm and second air pump diaphragm in a sequential order.

5. The sequentially activated multi-diaphragm foam pump of claim 1 wherein the foamy mixture comprises an air to liquid ratio of about 2 to 1.

6. The sequentially activated multi-diaphragm foam pump of claim 1 wherein the liquid pump diaphragm pumps liquid soap into the mixing chamber.

7. The sequentially activated multi-diaphragm foam pump of claim 1 wherein the liquid pump diaphragm pumps sanitizer into the mixing chamber.

8. A foam dispenser comprising:
- a housing;
- a motor;
- a wobble plate;
- a receptacle for receiving a refill unit;
- a refill unit having a connector for connecting to the receptacle;
- a sequentially activated multi-diaphragm foam pump having
  - a liquid pump diaphragm for pumping liquid into a mixing chamber;
  - a first air pump diaphragm for pumping air into the mixing chamber; and
  - a second air pump diaphragm for pumping air into the mixing chamber;
- wherein the liquid pump diaphragm, the first air pump diaphragm and the second air pump diaphragm are one unitary member;
- wherein rotation of the wobble plate causes a sequential compression of the liquid pump diaphragm to be compressed, the first air pump diaphragm and the second air pump diaphragm;
- a foam cartridge downstream of the mixing chamber; and
- a foam outlet located downstream of the foam cartridge.

9. The foam dispenser of claim 8 wherein sequentially activated multi-diaphragm foam pump has a longitudinal axis and the liquid pump diaphragm, first air pump diaphragm and second air pump diaphragm are concentric about the longitudinal axis.

10. The foam dispenser of claim of claim 8 wherein the liquid pump diaphragm pumps liquid soap.

11. The foam dispenser of claim 8 wherein the liquid pump diaphragm pumps sanitizer.

12. A foam dispenser comprising:
- a housing;
- a motor;
- a wobble plate;
- a reservoir containing a foamable liquid;
- a foam pump having a plurality of diaphragm pumping chambers wherein each diaphragm pumping chamber is connected to the wobble plate;
- a wobble plate drive member;
- wherein at least one diaphragm pumping chamber pumps liquid and at least two diaphragm pump chambers pump air;
- a mixing chamber located downstream of the plurality of diaphragm pumping chambers for mixing liquid and air; and a foam cartridge located downstream of the mixing chamber for creating a foam from a liquid and air mixture; and an outlet for dispensing the foam;

wherein rotation of the wobble plate drive member causes the wobble plate to sequentially compress the plurality of diaphragm pump chambers.

13. The foam dispenser of claim 12 wherein the plurality of diaphragm pumping chambers are formed in a unitary resilient member.

14. The foam dispenser of claim 13 wherein the foamable liquid is a soap.

15. The foam dispenser of claim 13 wherein the foamable liquid is a sanitizer.

16. The foam dispenser of claim 13 wherein a longitudinal axis extends along a center of the foam pump and the liquid pump diaphragm, first air pump diaphragm and second air pump diaphragm are concentric about the longitudinal axis.

* * * * *